US006412563B1

(12) United States Patent
William St. Clair et al.

(10) Patent No.: US 6,412,563 B1
(45) Date of Patent: Jul. 2, 2002

(54) SYSTEM AND METHOD FOR ENHANCED CONDITIONING OF WELL FLUIDS CIRCULATING IN AND AROUND ARTIFICIAL LIFT ASSEMBLIES

(75) Inventors: Albert David William St. Clair, Bakersfield; Robert Timothy Dempsey, Aliso Viejo; Steven Keith Tetzlaff, Huntington Beach; David Lester Olson, Los Alamitos, all of CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/556,744

(22) Filed: Apr. 21, 2000

(51) Int. Cl.[7] ..... E21B 43/00; E21B 43/08; E21B 43/38; E21B 3/18

(52) U.S. Cl. ..... 166/372; 166/105.3; 166/236; 166/265

(58) Field of Search ..... 166/66.4, 105, 166/105.1, 105.3, 227, 230, 234, 235, 236, 265, 304, 369, 372

(56) References Cited

U.S. PATENT DOCUMENTS

| | | | | | |
|---|---|---|---|---|---|
| 2,139,975 | A | * | 12/1938 | Utt | 166/158 |
| 2,335,558 | A | * | 11/1943 | Young | 166/228 |
| 2,600,150 | A | * | 6/1952 | Abendroth | 166/228 |
| 4,241,787 | A | * | 12/1980 | Price | 166/105 |
| 4,476,925 | A | | 10/1984 | Cox | 166/105.1 |
| 4,537,257 | A | * | 8/1985 | Todd | 166/369 |
| 4,749,034 | A | * | 6/1988 | Vandevier et al. | 166/105 |
| 4,821,800 | A | * | 4/1989 | Scott et al. | 166/228 |
| 4,977,958 | A | | 12/1990 | Miller | 166/205 |
| 5,088,554 | A | * | 2/1992 | Aterbury et al. | 166/228 |
| 5,262,065 | A | | 11/1993 | Hansen | 210/747 |
| 5,293,935 | A | * | 3/1994 | Aterbury et al. | 166/228 |
| 5,314,018 | A | | 5/1994 | Cobb | 166/265 |
| 5,642,781 | A | * | 7/1997 | Richard | 166/231 |
| 5,857,521 | A | * | 1/1999 | Ross et al. | 166/296 |

FOREIGN PATENT DOCUMENTS

| | | | |
|---|---|---|---|
| GB | 2339816 A | 2/2000 | E21B/43/38 |
| GB | 2339818 A | 2/2000 | E21B/43/38 |

* cited by examiner

*Primary Examiner*—David Bagnell
*Assistant Examiner*—Jennifer H Gay
(74) *Attorney, Agent, or Firm*—Bracewell & Patterson, L.L.P.

(57) ABSTRACT

An artificial lift assembly is suspended from a string of conduit in a well inside a well casing. An encapsulation module is independently suspended from the conduit and encases the pump assembly with a jacket. A series of well fluid conditioning tools are mounted to the lower end of the jacket, including a tubular screen, a desander located behind the screen, a string of disposal conduit extending below the desander, and a nucleation device located above the desander. The entire weight of this fluid conditioning equipment is completely supported by the jacket and the conduit. The encapsulation module is completely sealed so that the well bore fluid is limited to entering the module and pump through the screen. The screen removes larger contaminants from the fluid such as rubber and trash. After the fluid passes through the screen, it enters the desander where solid matter such as sediment is removed from the fluid and eliminated through the disposal conduit. Finally, the fluid enters the nucleation device where its scale is decomposed. After these three clarifying phases, the fluid enters the pump assembly and is pumped to the surface.

20 Claims, 2 Drawing Sheets

SYSTEM AND METHOD FOR ENHANCED CONDITIONING OF WELL FLUIDS CIRCULATING IN AND AROUND ARTIFICIAL LIFT ASSEMBLIES

TECHNICAL FIELD

The present invention relates in general to improving the conditioning of well fluids, and in particular to an improved apparatus and method for conditioning well fluids that are pumped through artificial lift assemblies.

DESCRIPTION OF THE PRIOR ART

A typical well production fluid lift system utilizes an artificial lift assembly having a centrifugal pump mounted to the lower end of a string of production tubing in the well casing. The electrical motor for rotating the pump is usually located below the pump. The well fluid circulates around the pump assembly and is drawn into an intake port, which is usually located on the lower end of the pump. The well fluid is then pumped out through the string of tubing to the surface.

Well fluid commonly contains a number of impurities including sediment, production debris, such as rubber particles and other man-made trash, and scale, which is a naturally occurring substance. Sediment and production debris reduce efficiency and can cause damage as they pass through the system. If left untreated, scale causes plugging and wear in the pump assembly, as well as harmful deposition on the exterior of the pump assembly. External scale deposition causes elevated operating temperatures which can lead to reduced operational life. Thus, due to the presence of impurities in well fluid, it is desirable for the fluid being drawn into the pump to be at least somewhat "conditioned" to reduce the harmful effects of the impurities.

In the prior art, a number of methods and systems have been devised to improve the life and efficiency of production fluid lift systems in these harsh environments. Sand separators have been secured to the bottom of the pump assembly for separating sediment from the well fluid before reaching the pump. Nucleation devices for removing scale have also been mounted to the pump assembly. The weight of these devices is supported by the pump assembly. Due to the structural limitations of the pump assembly, the number and weight of the tools that can be deployed to further treat the well fluid are restricted.

In FIG. 1A of U.S. Pat. No. 4,749,034, a cylindrical jacket 27 is mounted to the lower end of the pump assembly 15 near its intake 19. The jacket limits the source of the well fluid entering the pump to an axial passage 39 (FIG. 1C). The jacket acts as an intake manifold for injecting additional cutting fluid (port 47) into the pump from the surface in order to reduce the viscosity of the well fluid. The entire weight of the jacket assembly is physically supported at flange 29 on pump 15 (FIG. 1A).

U.S. Pat. No. 4,537,257 describes a device for lifting well fluids that isolates the tubing/casing annulus from the produced fluids. As shown in FIG. 1 a shield 12 surrounds the pump assembly 11 and is sealed at its upper and lower ends with end caps 13, 14, respectively. Although the shield 12 is mounted directly to the string of production tubing 40 extending from the surface, additional tubing 20 is required below the shield. The extra tubing 20 must be sealed off against the wellhead casing 10 below the pump with a separate annular sealing device 30 (FIG. 2A). Each of the embodiments disclosed (FIGS. 2A–2C) require this additional seal support below tubing 20. Tubing 20 allows completely unconditioned well fluid to enter and circulate around the lift system. An improved system and method for conditioning well fluids that are pumped through artificial lift assemblies is needed.

SUMMARY OF THE INVENTION

An artificial lift assembly is suspended from a string of conduit such as production tubing in a well inside a well casing. An encapsulation module is independently suspended from the conduit and encases the artificial lift assembly with a jacket. A series of well fluid conditioning tools are mounted to the lower end of the jacket. These tools may include a tubular screen, a desander located behind the screen, a string of disposal tubing extending below the desander, and a nucleation device located above the desander. Not all three clarifying tools are required in each well. The entire weight of this fluid conditioning equipment is completely supported by the jacket and the conduit.

The encapsulation module is completely sealed so that the well bore fluid is limited to entering the module and pump through the screen. The screen removes larger contaminants from the fluid such as rubber and trash. After the fluid passes through the screen, it enters the desander, if employed, where solid matter such as sediment is removed from the fluid and eliminated through the disposal tubing. Finally, the fluid enters the nucleation device, if employed where its scale is decomposed. After these clarifying phases, the fluid enters the pump assembly and is pumped to the surface.

Accordingly, it is an object of the present invention to provide improved well fluid conditioning.

It is an additional object of the present invention to provide an improved apparatus and method for conditioning well fluids that are pumped through artificial lift assemblies.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

Figure 1A:
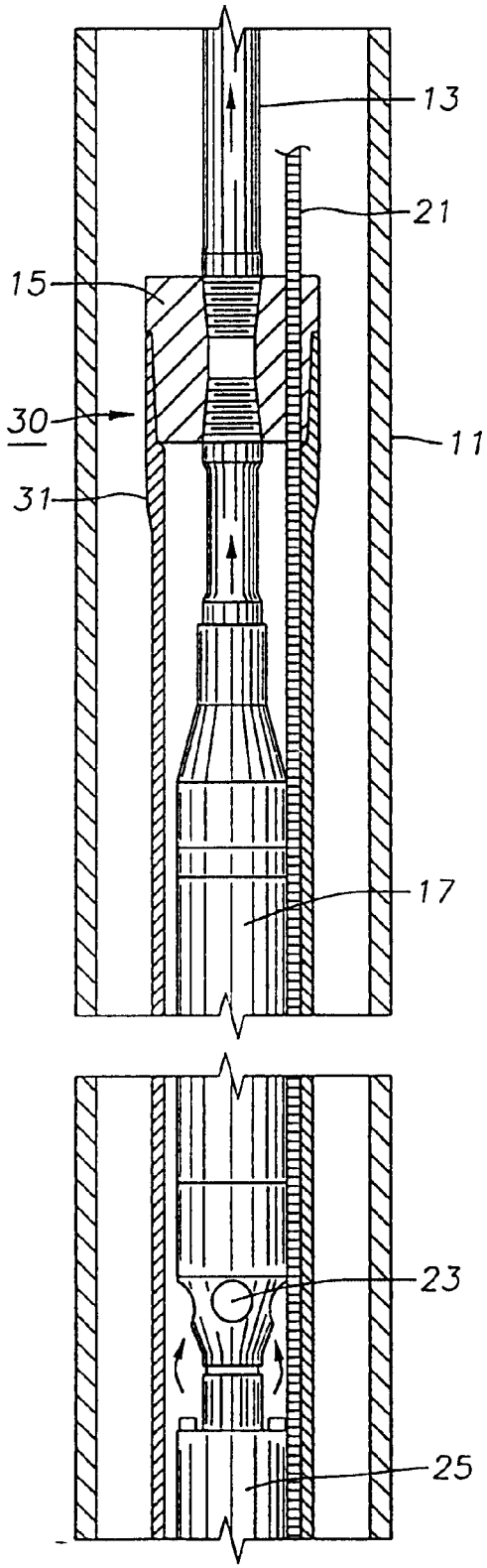
FIGS. 1A, 1B, and 1C are views, partially in vertical section, illustrating an apparatus for enhancing the conditioning of well fluids that circulate in and around artificial lift assemblies and is constructed in accordance with the invention.

Referring to FIG. 1A, a well contains well casing 11. A conduit 13 extends down into well casing 11 from the surface to an upper hanger 15. Conduit 13 may be sections of production tubing secured together, or it may be continuous, such as coiled tubing. An artificial lift assembly, which is this embodiment includes a centrifugal pump 17 and an electric motor 19 (FIG. 1B) for driving pump 17, is suspended from the upper hanger 15. A power cable 21 also extends down from the surface for providing electric power to motor 19. Power cable 21 passes through a milled slot in upper hanger 15 and is sealed thereto on the top side with an O-ring. Other types of artificial lift assemblies, rather than centrifugal pumps may be utilized, such as progressive cavity pumps.

Figure 1B:
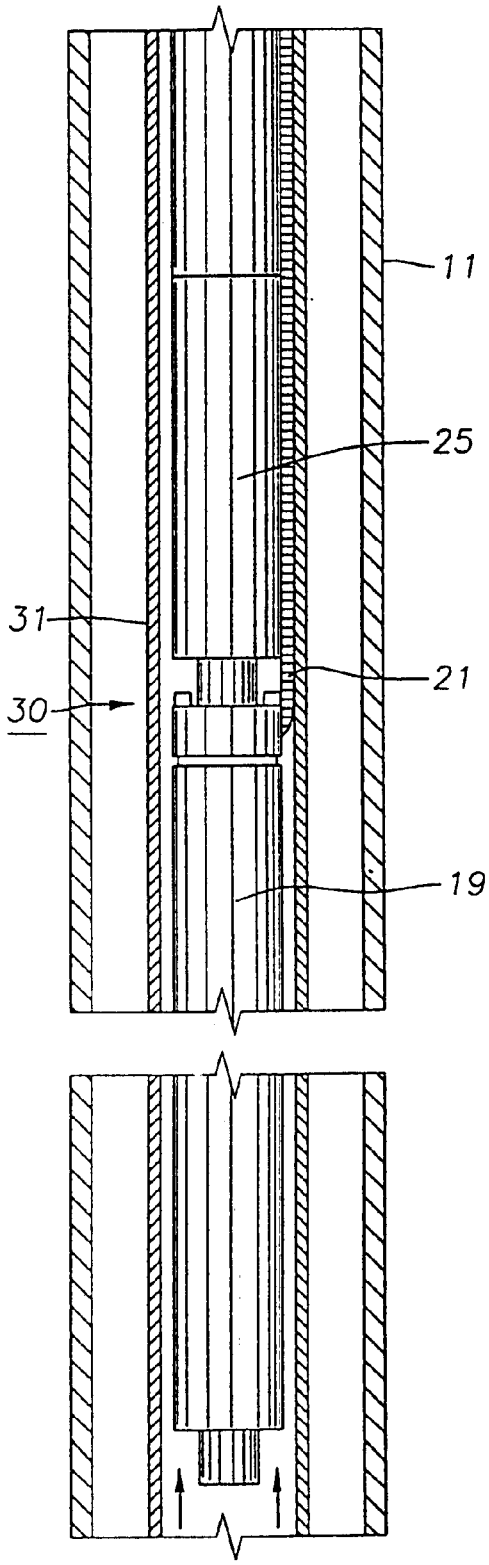

Pump 17 is of a conventional type having a number of stages of impellers and diffusers (not shown) for pumping fluid through the conduit 13 to the surface. If coiled tubing is employed for conduit 13, rather than sections of production tubing, the well fluid may be discharged into an annulus surrounding conduit 13, rather than flowing through conduit 13. In the embodiment shown, the upper end of pump 17 is directly connected through upper hanger 15 to tubing 13 for discharging all of the fluid from pump 17 through conduit 13 to the surface. Pump 17 has a fluid intake 23 on it lower end. As shown in FIGS. 1A and 1B, a seal section 25 is located between pump 17 and motor 19 for equalizing pressure in motor 19 with hydrostatic pressure, and for sealing well fluid from motor 19.

Referring again to FIG. 1A, an encapsulation module 30 is also suspended from upper hanger 15 such that the entire weight of encapsulation module 30 is directly supported by the conduit 13, not the artificial lift assembly (e.g., pump 17, motor 19, and seal section 25). Encapsulation module 30 has a hollow cylindrical shroud or jacket 31 mounted to upper hanger 15. The diameter and length of jacket 31 may be sized for a variety of applications. In the embodiment, shown, jacket 31 is threadingly secured and sealed to an exterior of upper hanger 15. The outer diameter of jacket 31 is smaller than the inner diameter of well casing 11, and the inner diameter of jacket 31 is larger than the outer diameter of the components of the artificial lift assembly.

Figure 1C:
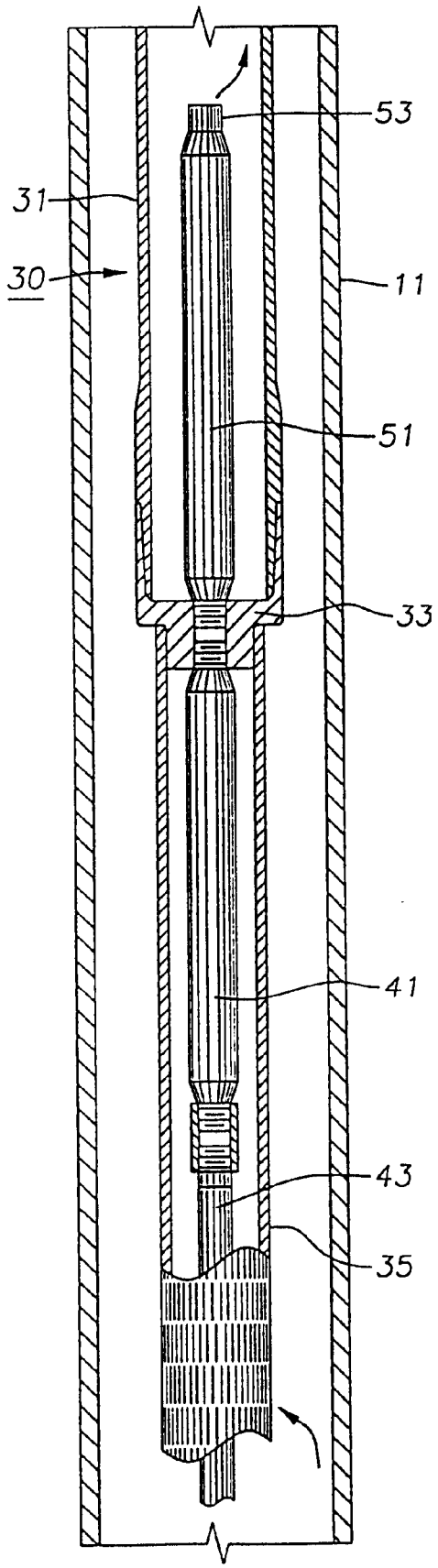

As shown in FIGS. 1B and 1C, jacket 31 extends down into well casing 11 beyond the lower end of motor 19. An unsupported lower hanger 33 (FIG. 1C) is mounted and sealed to the lower end of jacket 31 for supporting additional tools and well fluid conditioning or "clarifying" equipment. The jacket 31, lower hanger 33, and equipment are all free of contact with well casing 11. The entire assembly is screwed together utilizing sealing flush joint threads. A tubular screen 35 is secured to lower hanger 33 and extends further down into well casing 11. The screen 35 is provided with enough intake surface to filter or isolate rubber, trash, or other large debris from the production intake 23.

A conventional desander or sand separator 41, which is located within an interior of screen 35, may be employed. If so, sand separator 41 will be secured to lower hanger 33. Sand separator 41 is a passive centrifugal separator and may weigh approximately 50 to 100 lbs. By isolating the sand separator 41 in this manner, the rubber cup that is typically a part of the desander installation (a potential source of well bore contamination) is eliminated. A string of solids collection or disposal conduit 43 is secured to the lower end of sand separator 41. Conduit 43 extends further down the well along with screen 35. The axial length of screen 35 and conduit 43 varies based upon the remaining distance below lower hanger 33. Using modern deployment systems, as little as 60 linear feet of each of screen 35 and conduit 43 may be used. However, other installations of over 500 feet may be used. The only limitations of this new system are the size and strength of conduit 43, and the depth of the well.

If desired, a conventional nucleation device 51 may also be employed. If so, nucleation device 51 preferably protrudes internally upward from the lower hanger 33 into the interior of jacket 31. The lower end of nucleation device 51 will be secured to lower hanger 33. The nucleation device 51 changes the molecular structure of the scale that is typically a part of the produced fluid. The addition of the nucleation device 51 helps to eliminate the necessity to introduce chemical treatment to the well bore. Nucleation device 51 is in fluid communication with sand separator 41 located therebelow, and has an outlet port 53 at its upper end which is axially spaced below the lower end of motor 19. The entire weight of the fluid conditioning equipment (e.g., lower hanger 33, screen 35, sand separator 41, solid disposal conduit 43, and nucleation device 51) is completely supported by jacket 31, which, in turn, is completely supported by conduit 13. The artificial lift assembly is not required to support any of this additional equipment.

In operation, the encapsulation module 30 is sealed at both its upper and lower hangers 15, 33 so as to completely encase the artificial lift assembly from the well bore fluid. The fluid is limited to entering encapsulation module 30 through the screen 35 on the lower end of the module 30. Screen 35 acts as a first line of defense for conditioning the fluid by removing the larger contaminants from the fluid, such as rubber and trash. After the fluid passes through screen 35, it is drawn into desander 41 for a second phase of conditioning. In desander 41, solid matter such as sediment and sand are removed from the fluid. The solids are dropped down through the solid collections conduit 43 for disposal, while the fluid is circulated upward into nucleation device 51. Nucleation device 51 acts as a third fluid conditioning phase by changing the molecular structure of the scale that is inherently present in the fluid. The thrice-cleansed fluid exits nucleation device 51 at port 53 where it continues to circulate upward around motor 19, seal section 21, and pump 17 into its intake 23. Pump 17 then forces the conditioned well bore fluid through conduit 13 to the surface.

The invention has many advantages as a reduced cost lift system that cleans up and improves the condition of the well bore fluid before it reaches the pump intake. The encapsulation module provides an encased, isolated environment in which submersible lift systems can operate without direct exposure to harsh, unconditioned well fluids. This encapsulation or isolation of the lift system ensures that only fluids that have been clarified or "cleaned up" will enter the pump. The isolation capability of the module also improves the efficiency of the specialized tooling utilized in each installation. In addition, the module provides a more robust means of deployment for a series of specialized tools that enhance the efficiency and longevity of the submersible lift system. The entire assembly is screwed together utilizing sealing flush joint threads. The module can be installed in any application with sufficient annular space to accept the diameter of the capsule itself. This includes horizontal completions as well as vertical/deviated holes.

The encapsulated module also increases the capacity of the "solids" string by taking weight off the lift system and transferring it to the conduit string. Previously, the number of tools and the weight of the deployed tools was limited to the design weight limitations of the artificial lift assembly. However, by hanging the capsule from the conduit both the number and weight of the deployed tools may be increased over prior art systems and methods. Furthermore, the ability to add to the string below the desanding unit increases the life and efficiency of that unit, as well as the life and efficiency of the pump system. The capsule eliminates the rubber cup that is typically a part of the desander installation and a potential source of well bore contamination. With direct installation into the lower hanger of the capsule, the encapsulation system also eliminates the packers and pack-off elements that would be installed in traditional applications of "clean-up" tools.

While the invention has been shown or described in only some of its forms, it should be apparent to those skilled in the art that it is not so limited, but is susceptible to various changes without departing from the scope of the invention.

What is claimed is:

1. In a well, a string of conduit and a lift system mounted to the string of conduit for delivering well fluid to the surface, the improvement comprising:

a jacket encasing the lift assembly;

well fluid conditioning equipment mounted to the jacket below and separated from the lift assembly for conditioning well production fluid containing both water and oil drawn into the jacket via the lift assembly; and the jacket having a sealed upper end mounted to the string of conduit independently of the lift assembly, the jacket being suspended from the string of conduit by the sealed upper end such that in the operable position, a load path for the weight of the jacket and the well fluid conditioning equipment passes directly to the string of conduit and bypasses the lift assembly.

2. The well of claim 1 wherein the well fluid conditioning equipment comprise a screen for filtering debris from the well production fluid.

3. The well of claim 1 wherein the well fluid conditioning equipment comprises a desander for removing sediment from the well production fluid.

4. The well of claim 1, further comprising:

an upper hanger secured to a lower end of the string of conduit and the upper end of the jacket, and the artificial lift assembly being mounted to the upper hanger; and a lower hanger for mounting the well fluid conditioning equipment to the lower end of the jacket.

5. The well of claim 1 wherein the well fluid conditioning equipment has an upper end spaced axially below a lower end of the artificial lift assembly.

6. In a well, a string of conduit and a lift system mounted to the string of conduit for delivering well fluid to the surface, the improvement comprising:

a jacket encasing the lift assembly;

well fluid conditioning equipment mounted to the jacket for conditioning well production fluid drawn into the jacket via the lift assembly;

the jacket having a sealed upper end mounted to the string of conduit independently of the lift assembly such that a load path for the jacket and the well fluid conditioning equipment passes directly to the string of conduit and bypasses the lift assembly; and wherein the well fluid conditioning equipment comprises a nucleation device for decomposing scale in the well production fluid.

7. In a well, a string of conduit and a lift system mounted to the string of conduit for delivering well fluid to the surface, the improvement comprising:

a jacket encasing the lift assembly, well fluid conditioning equipment mounted to the jacket for conditioning well production fluid drawn into the jacket via the lift assembly;

the jacket having a sealed upper end mounted to the string of conduit independently of the lift assembly such that a load path for the jacket and the well fluid conditioning equipment passes directly to the string of conduit and bypasses the lift assembly; and wherein the well fluid conditioning equipment comprises a screen for filtering debris from the well production fluid, a desander for removing sediment from the well production fluid, and a nucleation device for decomposing scale in the well production fluid.

8. A lift system for well production fluids from a well having a well casing, comprising in combination:

a string of conduit adapted to extend into the well;

a lift assembly secured to a lower end of the string of conduit;

an encapsulation module, comprising:

a jacket surrounding the lift assembly, the jacket having a lower end located below a lower end of the lift assembly, and a sealed upper end mounted to the string of conduit;

well fluid conditioning equipment mounted to the jacket for conditioning well production fluid drawn into the jacket through the conditioning equipment by the lift assembly the well fluid conditioning equipment being below and separated from the lift assembly by a space; wherein the weight of the well fluid conditioning equipment passes directly to the string of conduit, bypassing the lift assembly; and wherein the encapsulation module while in its operable position is free of any weight supporting contact with the well casing.

9. The lift system of claim 8 wherein the well fluid conditioning equipment comprises a tubular screen extending below the lower end of the jacket for filtering debris from the well production fluid.

10. The lift system of claim 8, further comprising:

an upper hanger secured to the lower end of the string of conduit; wherein the upper end of the jacket is secured to the upper hanger and the lift assembly is secured to the upper hanger.

11. The lift system of claim 8, further comprising a lower hanger secured to the lower end of the jacket, the well fluid conditioning equipment being secured to the lower hanger, with an upper end of the well fluid conditioning equipment being spaced below and separated axially from the lower end of the lift assembly.

12. The lift system of claim 8 wherein the lift assembly comprises a centrifugal pump, an electric motor located below the pump for driving the pump, and a seal section extending between the pump and the door.

13. A lift system for well production fluids from a well, comprising in combination:

a string of conduit adapted to extend into the well;

a lift assembly secured to a lower end of the string of conduit;

a jacket surrounding the lift assembly, the jacket having a lower end located below a lower end of the lift assembly, and a sealed upper end mounted to the string of conduit;

well fluid conditioning equipment mounted to the jacket for conditioning well production fluid drawn into the jacket through the conditioning equipment by the lift assembly; wherein the weight of the well fluid conditioning equipment is supported by the string of conduit independently of the lift assembly; and wherein the well fluid conditioning equipment comprises a desander extending downward from the lower end of the jacket for removing sediment from the well production fluid and dropping the sediment down through a solids collection conduit below the desander.

14. A lift system for well production fluids from a well, comprising in combination:

a string of conduit adapted to extend into the well;

a lift assembly secured to a lower end of the string of conduit;

a jacket surrounding the lift assembly, the jacket having a lower end located below a lower end of the lift assembly, and a sealed upper end mounted to the string of conduit;

well fluid conditioning equipment mounted to the jacket for conditioning well production fluid drawn into the jacket through the conditioning equipment by the lift assembly; wherein the weight of the well fluid conditioning equipment is supported by the string of conduit independently of the lift assembly; and wherein the well fluid conditioning equipment comprises a nucleation device extending upward from the lower end of the jacket for decomposing scale in the well production fluid.

15. The lift system of claim 14 wherein the well fluid conditioning equipment further comprises:

a tubular screen extending below the lower end of the jacket for filtering debris from the well production fluid; and a desander extending downward from the lower end of the jacket for removing sediment from the well production fluid and dropping the sediment down through a solids collection conduit below the desander, the solids collection conduit extending downward through the tubular screen.

16. A method for conditioning well production fluids that circulate in and around a lift assembly suspended on a string of conduit in a well, comprising:

(a) encasing the lift assembly in a jacket to form an encapsulated module;

(b) mounting the encapsulated module to the string of conduit such that the lift assembly and the jacket are independently supported by the string of conduit;

(c) mounting well fluid conditioning equipment to the jacket below and separated from the lift assembly, lowering the jacket and lift assembly into the well, then suspending the jacket in the well in an operable position such that the weight of the well fluid conditioning equipment and the jacket is supported entirely by the string of conduit; and (d) conditioning well production fluid with the well fluid conditioning equipment as the well production fluid containing both water and oil is drawn into the jacket through the conditioning equipment by the lift assembly.

17. The method of claim 16 wherein step (d) comprises filtering the well production fluid with a screen to move debris therefrom.

18. The method of claim 16 wherein step (d) comprises processing the well production fluid with a desander to remove sediment therefrom.

19. A method for conditioning well production fluids that circulate in and around a lift assembly suspended on a string of conduit in a well, comprising:

(a) encasing the lift assembly in a jacket to form an encapsulated module;

(b) mounting the encapsulated module to the string of conduit such that the lift assembly and the jacket are independently supported by the string of conduit;

(c) mounting well fluid conditioning equipment to the jacket; and (d) conditioning well production fluid with the well fluid conditioning equipment as the well production fluid is drawn into the jacket through the conditioning equipment by the lift assembly; and wherein step (d) comprises processing the well production fluid with a nucleation device to decompose scale therein.

20. The method of claim 19 wherein step (d) further comprises the following steps:

(e) filtering the well production fluid to remove debris therefrom; and (f) removing sediment from the production fluid.

* * * * *